US006864645B2

(12) United States Patent
Sun et al.

(10) Patent No.: US 6,864,645 B2
(45) Date of Patent: Mar. 8, 2005

(54) METHOD AND CIRCUIT FOR DRIVING A GAS DISCHARGE LAMP

(75) Inventors: Yiyoung Tony Sun, Beverly, MA (US); Takeshi Goriki, Osaka (JP); Hiroyasu Eriguchi, Lexington, MA (US)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/378,828

(22) Filed: Mar. 5, 2003

(65) Prior Publication Data

US 2004/0183463 A1 Sep. 23, 2004

(51) Int. Cl.[7] ..... G05F 1/00; H05B 41/36

(52) U.S. Cl. ..... 315/308; 315/224; 315/360; 315/DIG. 7

(58) Field of Search ..... 315/224–225, 315/291, 307–308, 360, DIG. 2, DIG. 5, DIG. 7

(56) References Cited

U.S. PATENT DOCUMENTS

| | | | | | |
|---|---|---|---|---|---|
| 4,912,374 | A | | 3/1990 | Nagase et al. | 315/244 |
| 5,402,043 | A | * | 3/1995 | Nilssen | 315/307 |
| 5,481,163 | A | * | 1/1996 | Nakamura et al. | 315/308 |
| 5,491,387 | A | * | 2/1996 | Saito | 315/307 |
| 5,569,984 | A | * | 10/1996 | Holtslag | 315/307 |
| 5,623,187 | A | * | 4/1997 | Caldeira et al. | 315/307 |
| 5,828,185 | A | * | 10/1998 | Fellows et al. | 315/246 |
| 5,910,709 | A | * | 6/1999 | Stevanovic et al. | 315/225 |
| 5,932,976 | A | * | 8/1999 | Maheshwari et al. | 315/291 |
| 6,020,691 | A | | 2/2000 | Sun et al. | 315/307 |
| 6,144,172 | A | | 11/2000 | Sun | 315/291 |
| 6,181,084 | B1 | * | 1/2001 | Lau | 315/291 |
| 6,316,881 | B1 | * | 11/2001 | Shannon et al. | 315/219 |
| 6,426,597 | B2 | | 7/2002 | Rast et al. | 315/219 |
| 6,448,720 | B1 | | 9/2002 | Sun | 315/219 |
| 6,577,078 | B2 | * | 6/2003 | Shen | 315/307 |
| 2002/0190665 | A1 | | 12/2002 | Sun | 315/224 |

OTHER PUBLICATIONS

Unitrode Application Note U–136A, entitled "Phase shifted, zero voltage transition design Considerations and the UC3875 PWM Controller," dated May 1997.

Unitrode Products document UC1875/6/7/8, entitled "Phase Shift Resonant Controller," dated Jul. 1999.

* cited by examiner

*Primary Examiner*—Thuy Vinh Tran

(74) *Attorney, Agent, or Firm*—Greenblum & Bernstein P.L.C.

(57) ABSTRACT

Circuit and method for driving a gas discharge lamp having a bridge converter. The bridge converter includes a plurality of switches. A controller turns on and off the plurality of switches. The circuit further includes a zero current sensor circuit. The controller senses at least one voltage differential to control a length of time that at least one of the at least four switches is on. The controller controls when at least one of the plurality of switches is turned on in accordance with an output of the zero cross sensor.

35 Claims, 5 Drawing Sheets

METHOD AND CIRCUIT FOR DRIVING A GAS DISCHARGE LAMP

BACKGROUND OF THE INVENTION

Many circuit topologies have been proposed for high intensity discharge (HID) lamp electronic ballasts. A first popular circuit arrangement is a buck regulator that is cascaded with a full bridge low frequency inverter. A second popular circuit arrangement is a buck regulator and a low frequency inverter combined in a full bridge configuration. With technology advances in semiconductor and discrete components, the latter design is becoming more popular, as it is more efficient and less costly to manufacture. In particular, the second circuit arrangement is easier to generate a resonant ignition voltage, which is considered better to start an HID lamp, than a pulse method produced by the first circuit arrangement.

U.S. Pat. No. 6,426,597 to Rast et al. discloses a full bridge circuit having four switches S1–S4. The resonant ignition is generated by a series resonant circuit formed by inductor L1 and capacitor C1. A smoothing circuit (or filter circuit) is provided that has a further inductor L2 and a further capacitor C2. The smoothing circuit enables a linear mean value of a branch current $i_{L2}$, that flows by way of a bridge branch, to be applied to a gas discharge lamp (HID).

In order to ignite the HID lamp EL, two switches that are on the opposite side of the resonant network (e.g., inductor L1 and capacitor C1) are completely open with the aid of a suitable control circuit. The remaining two switches that are on the same side of the resonant network are alternately opened and closed. The switching frequency is slowly lowered in the direction of the resonant frequency of the series resonant circuit. The ignition voltage of the gas discharge lamp EL has, as a rule, already been reached before the resonant frequency is reached. In this case, the switching frequency for switches S3 and S4 is kept at this frequency until the gas discharge lamp EL ignites.

Unitrode Application Note U-136A (dated May 1997) and Application Note UC 1875/6/7/8 (a.k.a. SLUS229) disclose a similar method, wherein a full bridge is symmetrically operated at a high frequency. As disclosed in Application No. U-136A, switches QA and QD are closed, so that a primary current rises. From time t(0) to time t(1), which is a right leg transition, switch QD is off. Parasitic output capacitance CD starts to be charged and parasitic output capacitance CC starts to be discharged. Once the right leg transition is complete, the primary current free wheels through switch QA and the body diode of parasitic output QC. The current remains constant (assuming no loss), or decays slowly (with a loss) until the next transition occurs. Because of the high frequency symmetric operation of the full bridge, switch QC turns on within period t(1) to t(2) for a zero voltage switching. For an asymmetric high frequency operation, switch QC will stay off during this period. Period t(2) to t(3) is the left leg transition. Switch QA will now be turned off. The primary current will continue to flow, but the path has changed to the output capacitance of switch QA instead of its channel.

Both devices lack an ability to protect the circuit during normal operations and during starting. Furthermore, the devices also do not provide a way to overcome other sensed non-normal performance parameters of the lamp circuit. The present invention, as set forth below, overcomes these deficiencies.

SUMMARY OF THE INVENTION

In accordance with an object of the present invention, a circuit (buck convertor) is disclosed that drives a gas discharge lamp. The circuit includes a controller, a bridge circuit (such as, but not limited to, a full bridge circuit) that controls two output networks. Although the following discussion is provided with respect to a full bridge circuit, it is understood that the present invention is also applicable to circuit arrangements, such as, for example, a half-bridge circuit without departing from the scope and/or spirit of the instant invention. The full bridge circuit supplies power to the two output networks. A first output network generates a resonant voltage to ignite the lamp during a starting operation, while a second output network supplies an equivalent DC current after a breakdown in the starting operation before a normal operation occurs, and for powering the lamp in the normal operation after starting. In the normal operation, the controller senses a lamp voltage, and generates a reference of a peak current of the buck converter based on a lamp voltage. A reference of the zero current sensing (ZCS) signal is generated based on the phasing of the lamp current.

The controller, in starting before the normal operation, sweeps a frequency to generate an ignition voltage. When no lamp breakdown is detected, an intermittent operation is carried out. According to the present invention, a general-purpose microprocessor is used for the controller. However, it is understood that alternative devices may be used for the controller without departing from the spirit and/or scope of the present invention.

It is a feature of the present invention that components in the circuit for driving a gas discharge lamp will not overheat and/or will not cause an over-voltage at the lamp terminals in starting with intermittent operation. The lamp will start and re-start reliably after a breakdown and will then transition into a normal operation by applying an equivalent DC current through the lamp right after the breakdown or by providing ample time to cool the lamp before re-starting.

To further explain this feature, in starting mode before normal operation, the controller sweeps frequencies between a first frequency f1 and a second frequency f2, such as back and forth from a high frequency to a low frequency, or from a low frequency to a high frequency. Two networks are connected to the full bridge inverter. A first network generates the ignition voltage and a second network supplies a predetermined DC current through the lamp right after breakdown, but before the normal operation. The first network of the full bridge inverter comprises an inductor, a capacitor, and a resistor (LCR) series resonant network, with a resonant frequency between frequency f1 and frequency f2. When the full bridge frequency approaches the resonant frequency, a high resonant voltage appears across the inductor and the capacitor. The second network of the full bridge inverter includes an inductor and capacitor (LC) that is in series with the lamp load and in parallel with the capacitive element. When diagonal switches of the full bridge are switched asymmetrically, that is, one switch pair turns on longer than the other switch pair does, an equivalent DC voltage appears across the capacitive element. An equivalent DC current will then flow through the lamp load after breakdown.

To further explain this feature, in the starting mode before the normal operation, the controller detects whether the lamp is broken down electrically by sensing the lamp voltage directly or an equivalent lamp voltage. If the lamp has not broken down, an intermittent operation is carried out to reduce a component temperature due to a high quality factor resonant circuit and to reduce an RMS voltage at the lamp terminals. If the lamp has broken down, the normal operation follows the starting.

The intermittent operation has four periods. A first period comprises an ignition period that lasts t1 seconds. During this period, a very high resonant ignition voltage appears at the lamp terminals. A second period follows the first period and lasts t2 seconds. During this period, the output is off. In the disclosed invention, the time period t2 is generally more than 10 times longer than t1. However, the period of time period t2 can vary without departing from the spirit and/or scope of the invention. A third period, t3, is a multiple of the combination of times t1 and t2. That is, times t1 and t2 are repeated for the duration of time t3. A fourth period follows the third period, with all switches being in an off mode. This period, generally, is on the order of minutes. The purpose of this period is to provide ample time for the lamp to cool before the next burst of ignition voltage. This method avoids the situation of a lamp being stuck in a glow mode.

Another feature of the invention is that the circuit for driving a gas discharge lamp can safely and reliably disengage the lamp with different time delays depending upon what kind of faults occur at the lamp. The faults can be, for example, shorted lamp leads, rectified lamp electrodes, a leaking arc tube, and no lamp being present. However, it is understood that alternative faults may also be sensed by the present invention without departing from the spirit and/or scope of the present invention.

In the normal operation mode after the starting mode, the lamp voltage is sensed by the controller in, for example, every low frequency cycle. The sensed lamp voltage is compared to several pre-determined reference voltages. A first pre-determined reference voltage corresponds to a short circuit voltage. If the present lamp voltage is less than the first pre-determined reference voltage, a short circuit situation exists and a first internal counter having a first time T1 starts. A second pre-determined reference voltage corresponds to a voltage differential between two half cycles. If the voltage differential is greater than the second pre-determined reference voltage, a rectification mode exists and a second internal counter having a second time T2, starts. A third pre-determined reference voltage corresponds to a leaking lamp voltage. If the present lamp voltage is less than the pre-determined reference voltage, but more than the short circuit voltage, a leaking lamp situation exists and a third internal counter having a third time T3, starts. A fourth pre-determined reference voltage corresponds to a no load voltage. If the present lamp voltage is more than the fourth pre-determined reference voltage, a no load situation exists and a fourth internal counter having a fourth time T4, starts. Generally speaking, time T1 is equal to time T2; time T2 is less than time T3; and time T3 is less than time T4. However, the time relationships can vary without departing from the scope and/or spirit of the present invention.

Another feature of the present invention is that the controller includes a general-purpose microprocessor that senses the lamp voltage, and produces the peak current reference of the full bridge buck converter based on the lamp voltage from a look-up table. The controller also produces the ZCS reference based on a phase of the lamp current, and controls the time-out circuit using one of the timers' one-pulse-mode (OPM) function. The microprocessor also controls a minimum operating frequency using one of the timers' software interrupt. However, it is understood that alternative controllers may also be used without departing from the spirit and/or scope of the present invention.

In the normal operation, the controller senses the lamp voltage or an equivalent lamp voltage in, for example, every half cycle of the low frequency square wave. Depending upon the value of the sensed voltage, a duty cycle of a pulse width modulation (PWM) timer is loaded by, for example, a look-up table. An average voltage of the PWM timer's output corresponds to a reference input of the comparator for a peak current detection. However, it is understood that alternative timers may also be used without departing from the spirit and/or scope of the present invention.

In the normal operation, the controller opens or shorts a resistor at the reference input of the ZCS comparator. The reference input is varied between at least two values. When switch pair Q1 & Q4 is active, the ZCS reference is set HIGH. When the switch pair Q2 & Q3 is active, the ZCS reference is set LOW.

With respect to the one-pulse-mode (OPM) function, in the normal operation, one of the timers starts to count on a rising (or a falling) edge of a turn-on signal. At least two variables are associated with the timer. When the timer count reaches a first variable before another new turn-on signal, the low frequency side switches (Q1 & Q2) will be turned off. When the timer count reaches a second variable, a turn-on signal is generated. One of the high frequency side switches (Q3 or Q4) is forced to turn on. The first variable will be reached only when the lamp voltage is lower than a typical value. The second variable will be reached only when no turn-on signal is generated from the ZCS circuitry within the duration of the second variable. If desired, additional variables may be employed. The duration of the second variable corresponds to a minimum frequency at which the gas discharge lamp driving circuit will operate. Through the use of the timers, an audible noise is avoided. It is noted that the at least two variables can be either fixed or adaptive to the lamp voltage.

It is another feature of the present invention that the controller also includes two high-speed comparators for the zero current sensing (ZCS) and for sensing the peak full bridge buck current in normal operation mode. Some logic gates are also used to form a flip-flop and directing the control signals. ZCS is accomplished by sensing the voltage at the junction of switches Q3 & Q4 (this is shown as point A) with the aid of the reverse recovery time of either switch Q3 or switch Q4.

According to another feature of the present invention, a circuit that drives a gas discharge lamp is powered from a DC voltage source from either a rectified and/or filtered AC source or from a pre-conditioner such as boost power factor correction (PFC) convertor. In the latter case, the voltage can be different between a starting operation and a normal operation. A higher DC bus voltage may be better in the starting operation to generate the ignition voltage, while a lower DC bus voltage in the normal operation helps to reduce power losses. The reference voltage for the peak current detection comparator is generated by a filtered PWM square wave from the controller. A time constant of the filter is longer than a PWM's.

According to another feature of the present invention, the output power of the circuit that drives a gas discharge lamp is substantially flat for a lamp voltage of from approximately 70V to about 140V, whereas conventional electronic ballasts on the market usually output power parabolically from about 85V to about 120V. When the lamp voltage is greater than approximately 140V, the lamp power is reduced to protect the circuit from over powering. When the lamp voltage is further increased to approximately 250V, the lamp power is maintained at a predetermined power level, such as, but not limited to, approximately 30W. This corresponds to a minimum output power that is needed to avoid hanging in a glow mode during a lamp warm-up after ignition. Because of the controlled output characteristics of the circuit from 0V to 300V, an incandescent lamp operation is possible.

A still further feature of the present invention is that the turn-on signal for switch Q3 (or switch Q4) is generated by a rising edge (or the falling edge) of the voltage at point A (see FIG. 1), respectively. The rising edge (or the falling edge) is created by the resonance of a parasitic capacitance and a buck filter inductor, with the help of the reverse recovery current. Thus, a soft switching can be realized.

One aspect of the invention includes a circuit employing a bridge converter having a plurality of switches to drive a gas discharge lamp, the circuit comprising, a controller that controls a switching operation of the plurality of switches, and a zero current sensor that senses a current % flowing through at least one of the switches, wherein the controller senses a voltage differential to control a period of time that at least one switch of the plurality of switches is turned on, the controller determining when to turn on the at least one switch in response to a signal produced by an output of the zero current sensor. The controller controls the switching operation to provide a substantially constant power to gas discharge lamp circuit. The circuit also has the at least one of the plurality of switches being forced on by the controller based on an elapse of a second predetermined time period when there is no output from the zero current sensor. The circuit further has the controller turning on a first switch of the plurality of switches at least when another switch of the plurality of switches is on during a first half of a cycle of a square wave current, the controller turning off a second switch and a third switch of the plurality of switches during the first half of the cycle of the square wave current, the controller alternately turning on and off the another switch during the first half of the cycle of the square wave current. The circuit also has the controller turning off the first switch and the another switch during a second half of the cycle of the square wave current, the controller turning on and off the third switch during the second half of the cycle of the square wave current, the controller turning on the second switch of the plurality of switches at least when the third switch is on during the second half of the cycle of the square wave current. The circuit also includes an ignition network, a bulk filter, and a peak current sensor circuit. The circuit also includes all switches are forced off by the controller based upon an elapse of a first predetermined time period when there is no output from the zero current sensor. The circuit-including the controller that is a microprocessor. The circuit further includes the bridge converter that is a full bridge converter or the bridge converter that is a half bridge converter. The circuit with the ignition network comprising at least a resistor, a inductor, and a capacitor. The circuit may have the bulk filter that is a inductor and a capacitor. The circuit can also include the plurality of switches having inversely connected diodes in parallel, MOSFETs with internal inversely connected diodes, and IGBT switches with internal inversely connected diodes, and the controller generates a zero current sensing reference and a peak current sensing reference.

In another embodiment, the invention can be a method for driving a discharge lamp, that includes obtaining a first voltage differential in a lamp circuit, determining whether a first predetermined condition exists based upon the first voltage differential, performing a first predetermined operation when it is determined that the first predetermined condition exists for a first predetermined period of time, obtaining a second voltage differential in a lamp circuit, determining whether a second predetermined condition exists based upon a difference between the first voltage differential and the second voltage differential, performing the first predetermined operation when it is determined that the second predetermined condition exists for a second predetermined period of time, determining whether a third predetermined condition exists based upon the first voltage differential, performing the first predetermined operation when it is determined that the third predetermined condition exists for a third predetermined period of time, determining whether a fourth predetermined condition exists based upon the first voltage differential, and performing a second predetermined operation when it is determined that the third predetermined condition exists.

The method can be further defined in that the first predetermined operation is shutting down the lamp circuit, and the second predetermined operation is performing a starting operation for a fourth period of time.

The method may be further defined in that the first predetermined period of time is substantially equal to the second predetermined period of time, the third predetermined period of time being greater than the second predetermined period of time, and the fourth predetermined period of time being greater than the third predetermined period of time.

The method can also include determining whether a first predetermined condition exists by determining whether the first voltage differential is less than a first predetermined voltage, determining whether the second predetermined condition exists by determining whether the difference between the first voltage differential and the second voltage differential exceeds a second predetermined voltage, determining whether the third predetermined condition exists by determining whether the first voltage differential is less than a third predetermined voltage and more than the first predetermined voltage, and determining whether the fourth predetermined condition exists by determining whether the first voltage differential exceeds a fourth predetermined voltage.

According to a feature of the invention the first predetermined condition comprises a short circuit condition, the second predetermined condition comprises a rectification condition, the third predetermined condition comprises a leaking lamp condition, and the fourth predetermined condition comprises a no-load condition.

Another aspect of the invention includes a method for driving a discharge lamp, comprising generating a starting voltage in a discharge lamp circuit for a first start time period, sweeping a frequency of the starting voltage during the first start time period, measuring the lamp voltage, ending the starting when the lamp voltage is less than a predetermined voltage, and turning off the discharge lamp circuit when the lamp voltage is one of more than and equal to the predetermined voltage for a second start time period.

This method further includes that the sweeping of the frequency is from at least a first frequency to a second frequency, the sweeping of the frequency is from at least a first frequency to a second frequency and back to the first frequency, or the sweeping of the frequency is from at least a first frequency to a second-frequency and then from at least the first frequency to the second frequency. The method can also include ensuring that a resonant frequency of an ignition network of the discharge lamp circuit to be between the first frequency and second frequency. The method may also include repeating, for a third start time period, generating the starting voltage in the discharge lamp circuit for the first start time period, measuring the lamp voltage, and turning off the discharge lamp circuit when the lamp voltage is one of more than and equal to the predetermined voltage for the second start time period.

The method wherein generating the starting voltage is switching on and off a first switch and a fourth switch of a bridge converter of the discharge lamp circuit synchronously, and switching on and off a third switch and a second switch of the bridge converter of the discharge lamp circuit synchronously, wherein a duty cycle of the first and fourth switches differ from a duty cycle of the third and second switches. The method can also include stopping the generating of the starting voltage for a fourth predetermined start time period when the third start time period elapses.

Finally the method can include lowering the bus voltage when the bus voltage is determined to be higher than a certain maximum value or raising the bus voltage when the bus voltage is lower than a certain minimum value required for the lamp to pass a glow-to-arc state.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
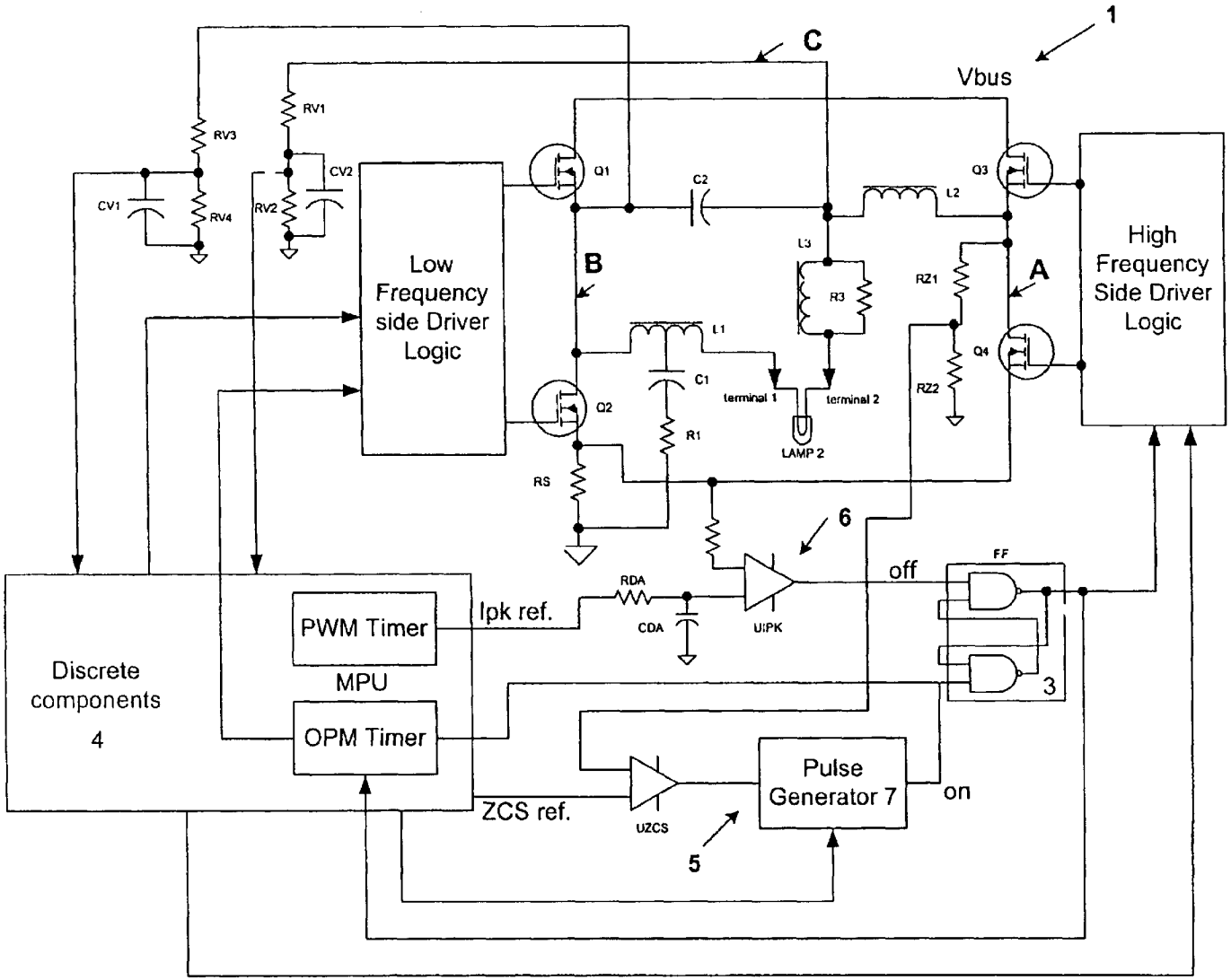
FIG. 1 shows a block diagram of a circuit that drives a gas discharge lamp in accordance with the present invention.

FIG. 1 shows a preferred embodiment of the present invention in a block diagram of a circuit 1 that drives a gas discharge lamp 2. The gas discharge lamp 2 is connected to two terminals (terminal 1 and terminal 2). Switching devices Q1–Q4 are configured to create a full bridge switching configuration. An inductor L1, capacitor C1, and resistor R1 are provided to form an ignition network. Inductor L2 and capacitor C2 form a buck filter network. Inductor L3 and resistor R3 limit a parasitic current through the lead capacitance in long lead applications (not shown). However, it is understood that alternative devices, circuit components and circuit arrangements may be used for the circuit without departing from the spirit and/or scope of the present invention. For example, although the invention has been described in conjunction with a full bridge, many aspects of the invention will work in a half bridge configuration.

The switching devices Q1–Q4 comprise any known switch type. In one embodiment, the switches can include inversely connected diodes in parallel to the switch. The switches Q1–Q4 can be MOSFETs or IGBT with internal inversely connected diodes. A reverse recovery time of the inversely connected diode of switch Q3 and switch Q4 may be longer than that of switch Q1 and switch Q2.

In a starting mode, switching devices Q1 and Q4 form a pair that synchronously turns on or off. At the same time switching devices Q2 and Q3 form a pair that operate synchronously off or on oppositely of switching devices Q1 and Q4. The exciting source to the ignition network and to the buck filter network is generated by turning on switch pair Q1 and Q4 pair for a period of time T_Q14_on. Then, all switches are turned off during a time period T_Q14_off. Then, switch pair Q2 and Q3 pair are turned on for a period of time T_Q23_on. Then, switches Q2 and Q3 are turned off for a time period T_Q23_off. All four periods may be individually determined based on the ignition pulses and based on the DC current flowing through the lamp 2 after breakdown. The rest of the controller 4 is disabled in starting mode.

In the normal operation mode, switches Q1 and Q4 form an active pair for half of a low frequency cycle. Switches Q2 and Q3 form an active pair for another half of the low frequency cycle. When switches Q1 and Q4 form the active half cycle, switch Q3 stays off. Switch Q4 switches on whenever there is an on signal from a zero current detection circuit 5 and a flip-flop 3 is reset. Switch Q4 switches off whenever there is an off signal from a peak current detection circuit 6 and the flip-flop 3 is set. Generally speaking, during this period, switch Q1 stays on.

When switches Q2 and Q3 are in the active half cycle, switch Q4 stays off. Switch Q3 switches on whenever there is an on signal from the zero current detection circuit 5 and the flip-flop 3 is reset. Switch Q3 switches off whenever there is an off signal from the peak current detection circuit 6 and the flip-flop 3 is set. Generally speaking, in this period, switch Q2 stays on.

During a normal operation, when flip-flop 3 is reset, a controller 4, such as a microprocessor, that includes an OPM timer/counter, is reset and starts to count. If the counter reaches a first variable when switches Q1 and Q4 are in an active half cycle, switch Q1 is turned off by controller 4 through a state change of an output of the OPM timer counter. When switches Q2 and Q3 are in the active half cycle, switch Q2 is turned off by controller 4 through the state change of the output of the OPM timer counter. The counter stops counting, the counter is reset, and is restarted whenever the flip-flop 3 is reset before the OPM timer counter reaches its first variable. In this case, the output state of the OPM timer counter will not change.

The portion of the circuit 1 comprising resistors RZ1 and RZ2 form a voltage divider that scales down the voltage at point A (see FIG. 1). The rising edge (or the falling edge) of the voltage at point A is used to sense the zero current status of switch Q4 (or switch Q3), respectively. When the internal body diode of switch Q4 has depleted all the electrons in its junction, the voltage at point A starts to rise. On the other hand, when the internal body diode of switch Q3 has depleted all the electrons in its junction, the voltage at point A starts to fall. A reference input of comparator UZCS of the zero current detection circuit 5 is set such that, to sense the falling edge, the reference voltage is less than a scaled voltage at point A before falling, and, to sense the rising edge, the reference voltage is greater than the scaled voltage at point A before rising. Controller 4 provides two reference levels that are varied by shorting or opening a resistor in a resistor divider that is connected to the reference input of comparator UZCS of the zero current detection circuit 5. When the zero current status is detected, a ZCS turn-on signal is generated. It should be noted that any device that senses a zero current may be used without departing from the spirit and/or scope of the present invention.

The switching efficiency can be improved through zero voltage switching (ZVS). This is accomplished by carefully selecting the reverse recovery time and the parasitic capacitance of switch Q3 and switch Q4, the buck filter inductance L2, the bus voltage, and the elapsed time from the rising edge or the falling edge to the actual turn-on of switch Q3 or switch Q4. Two equations need to be satisfied for ZVS to occur.

$$L_2 * Irr^2 > Cp * Vbus^2 \quad (1)$$

and $$td >= Cp * Vbus / Irr \quad (2)$$

where $L_2$ is the buck filter inductance;
Vbus is the bus voltage (e.g., rail to rail voltage);
Irr is a peak reverse recovery current;
Cp is the parasitic capacitance at point A; and
td is the elapsed time from the rising (or falling) edge of the voltage at point A to the actual turn-on of switch Q3 (or switch Q4).

Equation (1) assures that the energy in the buck filter inductor at current Irr is large enough to be transferred to the parasitic capacitance, causing its voltage to go from rail to rail. Equation (2) sets the time needed for the parasitic capacitance to be fully charged from rail to rail, after which time ZVS occurs, assuming the resonant frequency of inductor L2 and capacitor Cp is much lower than time td.

A pulse generator 7 is used to generate a pull-down pulse when an output transition from comparator UZCS occurs and switch Q3 and switch Q4 are both off. The pulse generator 7 will not respond to the output transition of comparator UZCS if one of the switches Q3 or Q4 is on right before the transition. An RC high pass filter (not shown) is sufficient to enable the pulse generator 7. However, other circuits may be used to achieve the pulse generation without departing from the spirit and/or scope of the present invention. The flip-flop 3 is reset after the pull down pulse from the pulse generator 7. Switches Q3 or Q4 will be turned on by the pull down pulse, depending upon the phasing.

Resistor RS is provided to convert a peak of the buck inductor current into a peak voltage that is fed to a peak current comparator UIPK. A reference input of the peak current comparator UIPK receives a signal from the PWM timer output of the controller 4 through a digital to analog converter formed by a resistor RDA and capacitor CDA. The output of comparator UIPK feeds a set (e.g., off) input of the flip-flop 3. When the flip-flop 3 is set, switch Q3 or switch Q4 will be turned off. However, it is noted that any alternative device or circuit may be used to determine the peak voltage and signal the switches without departing from the spirit and/or scope of the invention.

A lamp voltage is sensed at point B and at point C. Resistors RV1–RV4 and capacitors CV1–CV2 form a voltage divider and filter for points B and C. A difference between the voltage at point B and the voltage at point C is calculated by the controller 4, which is used to set a duty cycle of the PWM timer, which is the reference for the peak current detection comparator UIPK. The duty cycle is stored in a look-up table that is stored in, for example, the controller 4. The present lamp voltage is compared with four preset values to determine the status of the lamp 2. These values are used in a fault protection algorithm to be described below. It is noted that the storage location of the look-up table may be changed without departing from the spirit and/or scope of the invention.

Figure 2:
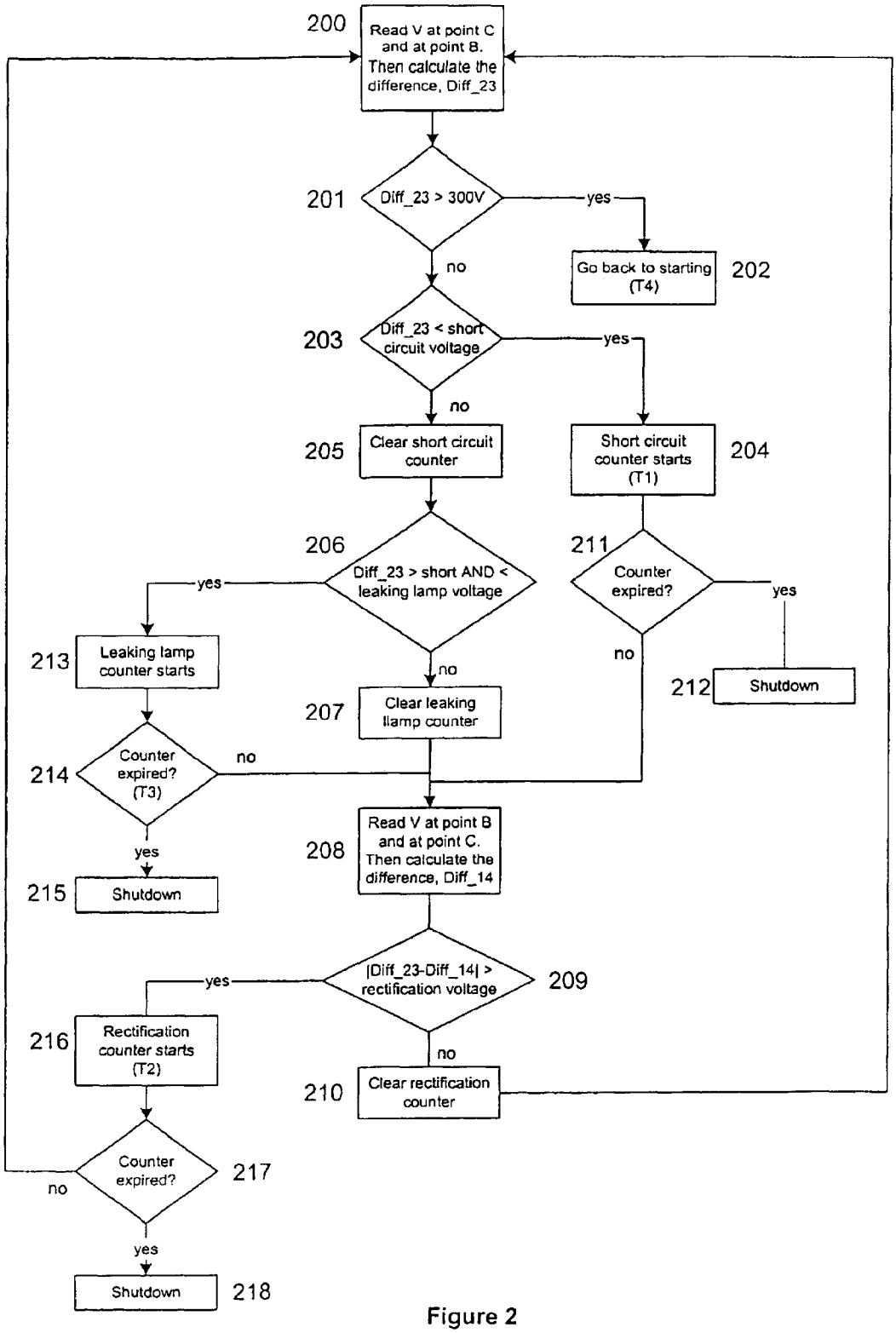
FIG. 2 shows a flow chart of a fault protection counter and its operation.

FIG. 2 describes the process of the fault detection algorithm operation. In step 200, the voltage at point C and point B is measured as described above. Then, the voltage difference between point C and point B is calculated by the controller 4.

If the present lamp voltage is less than a preset no-load value (.e.g, 300V in the disclosed invention), processing proceeds from step 201 to step 203.

At step 203, it is determined whether a short circuit exists. If the present lamp voltage is lower than a preset short circuit voltage, a short circuit situation exists and the short circuit counter starts in step 204. The short circuit counter continues to count as long as the short circuit persists, unless a first predetermined time, T1, such as, but not limited to, for example, 1.5 minutes is reached (step 211). If time T1 has expired, a short circuit is determined to exist, and the circuit 1 shuts itself off (step 212).

If the short circuit condition is eliminated prior to the expiration of time T1, processing goes from step 211 to step 208. In step 208, the lamp voltage difference Diff_14 between points B and C is calculated. If the lamp voltage differential Diff_14 between two half cycles is greater than a preset value (step 209), a lamp rectification situation exists and a lamp rectification counter starts at step 216. The lamp rectification counter continues to count as long as the rectification persists, unless a second predetermined time T2, such as, but not limited to, for example, 1.5 minutes is reached (step 217). If the second predetermined time T2 is reached, the circuit 1 shuts itself off (step 218).

If the rectification voltage condition ceases to exist before the expiration of the counter (step 217), processing returns to step 200. Similarly, if the determination at step 209 is negative, the rectification counter in cleared (step 210) and processing returns to step 200.

If it is determined at step 203 that a short circuit condition does not exist, processing proceeds to step 205 to clear the short circuit counter (step 205). Then, at step 206, it is determined whether the present lamp voltage is lower than a preset leaking lamp voltage, but higher than the short circuit voltage. If the determination is affirmative, a leaking lamp situation exists, and a leaking lamp counter starts counting (step 213). The leaking lamp counter will start to count and continue to count as long as the leaking lamp persists, unless a third predetermined time T3, such as, but not limited to, for example, 15 minutes is reached (step 214). If time T3 has expired, the circuit 1 shuts itself off at step 215. On the other hand, if the determination at step 214 is negative, processing proceeds to step 208 to calculate the voltage difference Diff_14, discussed above.

Figure 5:
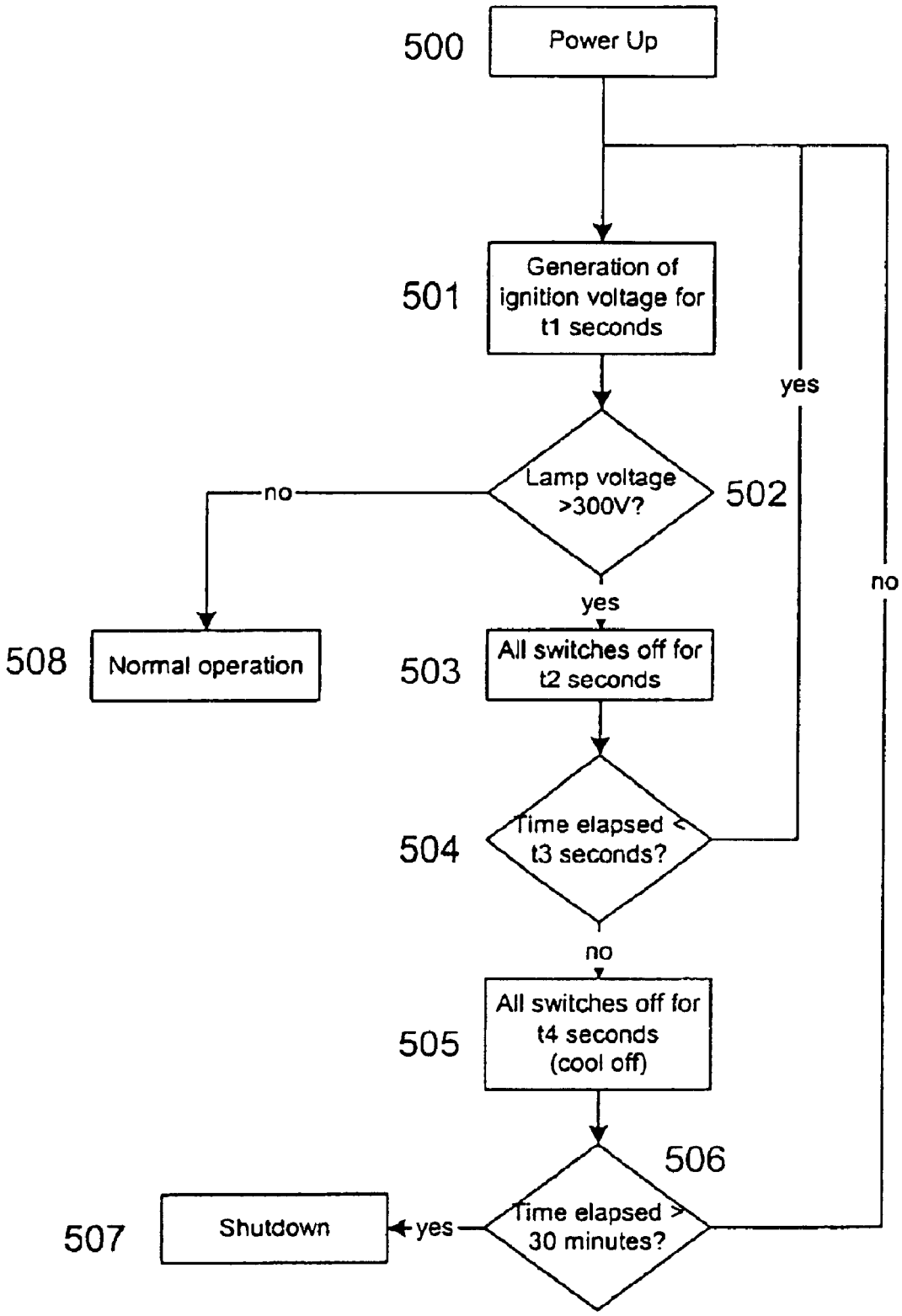
FIG. 5 shows a flow chart of the intermittent operation in the starting mode.

If, at step 201, the present lamp voltage is greater than a preset no-load value, processing proceeds to step 202 to enter the starting mode. The starting mode is described below in detail and in conjunction with FIG. 5 to be discussed below.

While in the starting mode, a no-load counter starts. The no-load counter continues to count as long as the no-load persists, until a fourth predetermined time T4, such as, but not limited to, for example, 30 minutes is reached. If the fourth predetermined time T4 is reached, the circuit 1 shuts itself off. In any case, the time-out counter will reset whenever the present lamp voltage does not satisfy the preset voltage.

In the disclosed embodiment, the following relationship between the respective times is satisfied: T1=T2<T3<T4. However, it is understood that this time relationship can be changed without departing from the scope and/or spirit of the invention.

The ignition voltage is generated using a frequency sweeping technique during the starting mode. The sweeping pattern of the excitation source can be very liberal. For example, it can start from a first frequency f1 and end at a second frequency f2, and then back to the first frequency f1. It can also start from the first frequency f1 and end at the second frequency f2, and then start from the first frequency f1 again and then end at the second frequency f2. The first frequency f1 can be greater (or lesser) than the second frequency f2. Assuming the first frequency f1 is greater than the second frequency f2, the first frequency f1 should be selected to be slightly greater than the resonant frequency of the minimum inductance and the minimum capacitance of the LCR resonant network of the circuit 1. The second frequency f2 should be selected to be slightly lower than the resonant frequency of the maximum inductance and the maximum equivalent capacitance of the LCR resonant network with the longest lamp leads.

To improve the starting performance of the lamp 2, an equivalent DC current is applied right after a lamp breakdown flowing through the lamp 2 occurs. If the excitation source is asymmetric, inductor L2 and capacitor C2 network provide the equivalent DC current. The magnitude of the ignition voltage is adjusted by the sweeping speed through the resonant frequency and by the duty cycle. The magnitude of the equivalent DC current is adjusted by the difference of the duty cycle. For example, switches Q1 and Q4 are turned on for T_Q14_on seconds; then, switches Q1 and Q4 are turned off for T_Q14_off seconds; then, switches Q2 and Q3 are turned on for T_Q23_on seconds; then, switches Q2 and Q3 are turned off for T_Q23_Off seconds; and then, the cycle repeats. Maximizing the duty cycle ((T_Q14_on/(T_Q14_on+T_Q14_off)) and/or (T_Q23_on/(T_Q23_on+T_Q23_off)) maximizes the ignition voltage. Adjusting the difference of two duty cycles optimizes the equivalent DC current for the lamp 2 after breakdown.

The intermittent starting operation will now be discussed.

Figure 3:
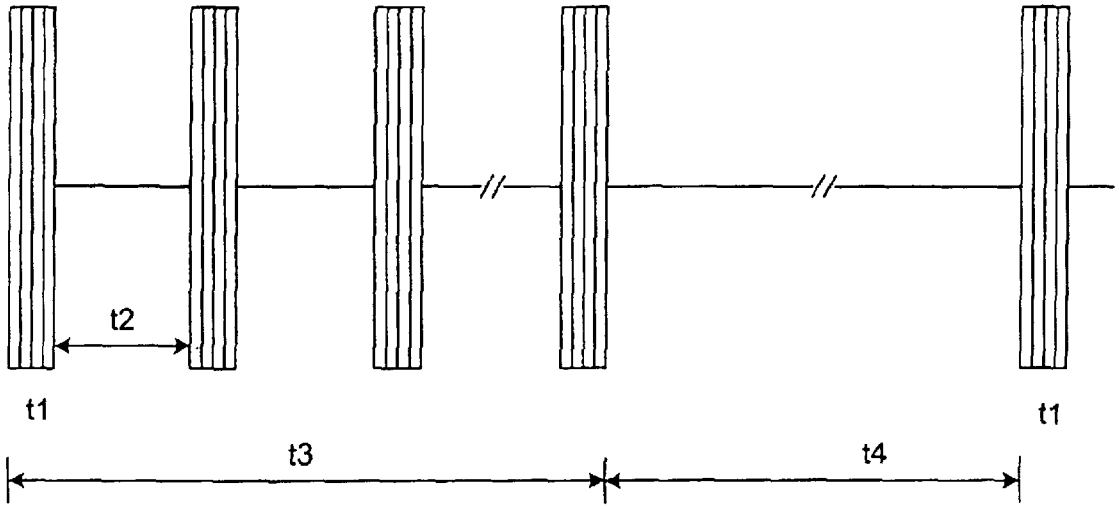
FIG. 3 shows a timing diagram of an intermittent operation during a starting mode.

In the starting mode, the ignition is generated by the very high quality factor LCR resonant circuit formed by the inductor L1, the capacitor C1, and the resistor R1. Under a no-load condition, if the resonant voltage is continuously applied, the switch and inductor losses will overheat these components. Additionally, a hazardous situation exists when the lamp terminal voltage is too high. To solve these problems, an intermittent operation is carried out to prevent overheating of the circuit 1 components and to decrease an electric hazard at the lamp terminals. The intermittent operation has four periods, as shown in FIG. 3 and the flow chart of FIG. 5. An ignition voltage is generated for time period t1 (FIG. 3) as shown in step 501 of FIG. 5. This time period should not be too long in order to avoid over-heating and creating an electric hazard. However, the period should not be too short in order to supply enough pulses to the lamp 2 to effect ignition of the lamp 2. For example, in the disclosed invention, the time period is approximately 100 ms. However, it is understood that other time period may be used without departing from the scope and/or spirit of the invention.

The detailed waveform within time period t1 is largely dependent upon the frequency sweeping pattern, as described above. Then, at step 502, it is determined whether the lamp voltage exceeds a predetermined voltage, such as, but not limited to, for example, 300 volts.

If the determination at step 502 is negative, processing proceeds to step 508 to initiate the normal operation mode. However, if the determination at step 502 is affirmative, all the switches are turned off for a second time period t2 at step 503. During this time period, the output of circuit 1 is zero. In the disclosed invention, this time period is typically more than 10 times of the first period t1. However, the actual time period is not critical and may be varied from that disclosed herein.

Thereafter, step 504 is executed, wherein the process of generating the ignition voltage and the off period are repeated until a third predetermined time t3 elapses. Time period t3 is long enough for the lamp 2 to be exposed to repeated ignition voltages and breakdowns, but short enough not to overhead the components of circuit 1 and to cause an electrical hazard. For example, in the disclosed invention, the time period t3 is approximately 20 seconds. However, this time period may be varied without departing from the scope and/or spirit of the invention.

Next, it is determined whether the third time period t3 has elapsed (step 504). When the third time period t3 has elapsed, the circuit 1 is completely off for a fourth time period t4 (step 505). This period is long enough for the lamp to cool off before the next ignition burst (e.g., t1 time period). In the disclosed invention, the fourth time period t4 is approximately 2 minutes, although it is understood that the actual time period is not critical to the operation of the present invention.

If the elapsed time at step 504 has not exceeded the third time period t3, processing returns to step 501 to repeat steps 501 through 504.

If it is determined (step 506) that the elapsed time exceeds a certain time period, such as, but not limited to, for example, 30 minutes in the disclosed example, processing proceeds to step 507 to initiate a shutdown. On the other hand, when the elapsed time is less than the certain processing proceeds from step 506 to step 501 to repeat the above-discussed procedure.

Figure 4:
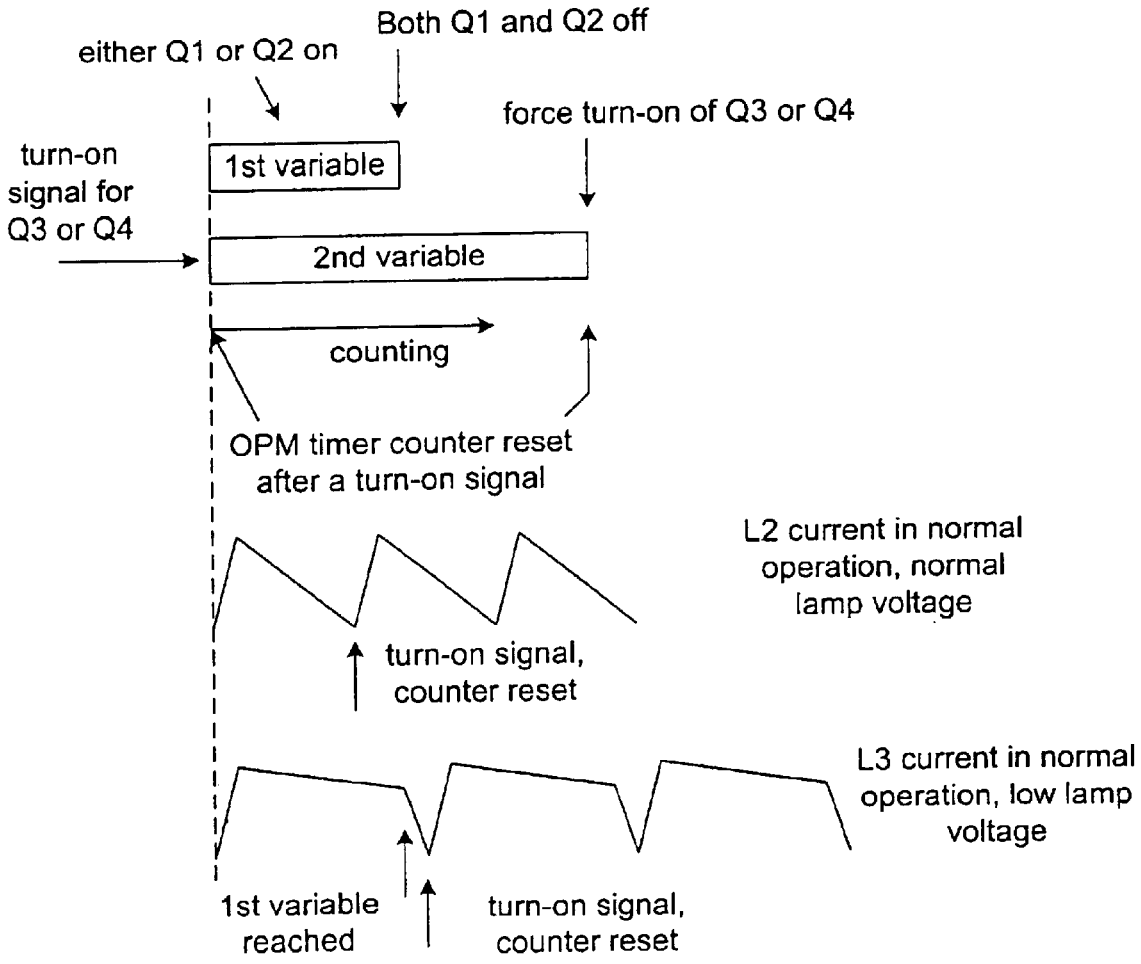
FIG. 4 shows a relationship diagram of a one-pulse-mode time counter, two counter variables, inductor L2 current, and the status of switches.

The variable switch timing, shown in FIG. 4, will now be described.

In the normal operation mode, when the lamp voltage is still lower than a typical value, the controller 4 sets a first variable in the one-pulse-mode (OPM) timer in accordance with a lamp voltage. The output of the OPM timer changes its state in response to a rising edge (or a falling edge) voltage applied to the input of the OPM timer. The output will remain at this state for the duration of the first variable. After the OPM timer counter reaches the first variable, the output of the OPM timer will change back to its original state. If a new rising edge (or a new falling edge) voltage occurs before the expiration of the duration of the first variable, the OPM timer counter is reset, and a new count is initiated. The output will not switch back to its original state. As long as the OPM timer output is in its original state, switches Q1 and Q2 are both off. As long as the OPM timer output is in its set state, either switch Q1 or switch Q2 will be on. The OPM timer count is initiated by a turn-on pulse produced at the output of the flip-flop 3. The first variable can be either fixed or adaptive to the lamp voltage. If the first variable is fixed, the frequency will vary from a low lamp voltage to a typical lamp voltage. If the first variable is adaptive to the lamp voltage, the frequency of the buck converter from the low lamp voltage to the typical lamp voltage can be constant.

There is another advantage of the variable first variable over the fixed first variable. During the phase transition of a low frequency current in the normal operation, a shorter first variable may prevent over-shooting the peak buck inductor current. It is noted that while the adaptive method is more flexible, software coding is more complicated.

In the normal operation, a second variable associated with the OPM timer is also set. Generally, the second variable is set once power is applied to the controller 4. The second variable is always larger than the first variable. When the OPM timer counter reaches the duration of the second variable, a turn-on signal is produced to reset the flip-flop 3. The OPM timer counter is then reset by the turn-on signal. The duration of the second variable corresponds to the minimum frequency that the full bridge buck converter will operate. Typically, it is greater than 20 kHz (e.g., 50 uS) to avoid audible noise. FIG. 4 shows the relationship of the counter variables and the buck current, in inductor L2, during the normal operation.

A forced on-trigger of switch Q3 or switch Q4 is generated by the controller 4 after a predetermined time elapses from the last on-trigger, if no voltage rise (or fall) is detected at point A during the period.

In the normal operation, the lamp power is controlled from a short circuit to a determined voltage of, for example (but not limited to) approximately 300 V. It is noted that in some other devices, the lamp power increases almost directly proportional to the lamp voltage from short circuit to about 50V. Too much power applied to the lamp 2 when the lamp voltage is still low will over-stress the lamp electrodes. Too little power applied to the lamp 2 when the lamp voltage is still low may cause the lamp 2 to extinguish, or lengthen a warm-up time. This may also stress the lamp electrodes of the lamp 2. In the present invention, a lamp voltage from a first voltage of, for example, about 70V to a second voltage of, for example, about 140V results in a lamp power that is controlled to be substantially constant. The very wide range of the constant lamp power ensures that lamps manufactured by different manufacturers, as well as lamps of different kinds and/or different ages will operate properly. Generally speaking, quartz lamps require a lower lamp voltage in comparison to ceramic lamps. When the lamp voltage is between the second voltage (e.g., 140V) to a third voltage of, for example, about 250V, the lamp power is rolled off to be approximately 30 W. In this lamp voltage region, the HID lamp 2 has already extinguished. It is noted that a precise power control is not necessary.

Controlling the lamp power is additionally beneficial when, for example, an incandescent lamp is mistakenly installed in place of the HID lamp. Rolling the power off from its rated value to a predetermined power level of, for example (but not limited to) about 30 W can prevent damage to, for example, the ballast. From the third voltage (e.g, about 250V) to a fourth voltage of, for example, about 300V, a minimum power such as, for example, about 30 W, can be provided to the lamp 2. This minimum power is especially useful for the lamp 2 to pass the glow state. After breakdown of the lamp 2, but before the electrodes are hot, the lamp 2 may occasionally fall back to the glow mode. In the glow mode, the lamp voltage is approximately 200V–300V. Without the supplied minimum power, the lamp 2 may hang in the glow state and finally extinguish. A lamp voltage greater than 300V is considered a no-load voltage. When a no-load voltage is sensed, the intermittent starting operation is carried out. In this regard, it is generally considered that 300V is the minimum voltage required to sustain a lamp current during starting right after the arc breakdown.

It has been found to be beneficial to make the bus voltage higher in the starting operation and lower in the normal operation. The high bus voltage in the starting operation helps to generate the ignition voltage, since the ignition voltage is proportional to the bus voltage. The LCR resonant network will be easier to design and Litz wires may not be necessary for the resonant inductor to have a low resistance. However, a high bus voltage will intrinsically have a higher loss for the buck converter circuit in the normal operation. The switching turn-off loss is also increased. As a result, in the normal operation, a low bus voltage is preferred.

There is another benefit to making the bus voltage adjustable, particularly with respect to having the same bus voltage in the starting and in the normal operation. In a boost pre-regulator, the DC output is usually regulated by the feedback loop through pulse width modulation. When an over-voltage condition occurs, the boost switch is turned off. The over-voltage condition will occur in time period t2 and in time period t4 when the output to the lamp 2 is turned off. The over-voltage threshold in most boost pre-regulators is approximately several percent higher than the regulated voltage. In other words, the bus voltage will be higher in time period t2 and in time period t4 than in time period t1 and in the normal operation. It is advantageous that the bus voltage be maintained at the same level at all times, as a better and more stable ignition is possible.

The bus voltage can be controlled by the controller 1 in conjunction with the voltage source. For example, a general-purpose microprocessor can be used to force the boost pre-regulator to run in the over-voltage mode during the entire period of starting, while the over-voltage threshold in starting is set at the same level as the regulated voltage threshold in the normal operation. However, it should be understood that alternative arrangements may be used to control the voltage without departing from the spirit and/or scope of the present invention.

The foregoing discussion has been provided merely for the purpose of explanation and is in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and/or spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims. The methods described herein may comprise dedicated hardware or software implementations. Further, it is understood that the invention may be implemented in software using techniques (programming) other than described herein.

We claim:

1. A circuit employing a bridge converter having a plurality of switches connected in series to drive a gas discharge lamp, the circuit comprising:

a controller that controls a switching operation of said plurality of switches; and a zero current sensor that senses a current flowing through at least one of said plurality of switches by sensing a voltage at a predetermined point of said plurality of switches, wherein said controller controls a period of time during which at least one switch of said plurality of switches is turned on in response to a sensed voltage differential and said controller determines when to turn on said at least one switch in response to a signal produced by an output of said zero current sensor.

2. The circuit of claim 1, in which:

at least one of said plurality of switches is forced on by said controller based upon an elapse of a predetermined time period during which there is no output from said zero current sensor.

3. The circuit of claim 1, in which:

at least one of said plurality of switches is forced off by said controller based upon an elapse of a predetermined time period during which there is no output from said zero current sensor.

4. The circuit of claim 1, in which:

at least one of said plurality of switches is forced on by said controller based upon an elapse of a predetermined time period during which there is no output from said zero current sensor; and at least one of said plurality of switches is forced off by said controller based upon an elapse of another predetermined time period during which there is no output from said zero current sensor, wherein said another predetermined time period is less than the predetermined time period.

5. The circuit of claim 1, further comprising:

a voltage sensor that senses a first voltage differential in the circuit, wherein said controller shuts down the circuit when a short circuit condition exists, indicating that said first voltage differential is less than a predetermined voltage for a predetermined time period.

6. The circuit of claim 1, comprising:

a voltage sensor that senses a first voltage differential in the circuit; and a second voltage sensor that senses a second voltage differential in the circuit, wherein said controller shuts down the circuit when a rectification condition exists, indicating that a difference between the first voltage differential and the second voltage differential exceeds a predetermined voltage for a predetermined time period.

7. The circuit of claim 1, further comprising:

a voltage sensor that senses a first voltage differential in the circuit, wherein said controller shuts down the circuit when a leaking lamp condition exists, indicating that the first voltage differential is less than a predetermined voltage and more than another predetermined voltage for a predetermined time period.

8. The circuit of claim 1, further comprising:

a voltage sensor that senses a first voltage differential in the circuit, wherein said controller performs a starting operation of the Circuit when a no-load condition exists, as indicated by the first voltage differential exceeding another predetermined voltage for a predetermined time period.

9. The circuit of claim 1, further comprising:

a voltage sensor that senses a first voltage differential in the circuit; and a second voltage sensor that senses a second voltage differential in the circuit;

said controller performing a first predetermined operation when said controller determines that a first predetermined condition exists for a first predetermined period of time, based upon the first voltage differential;

said controller performing the first predetermined operation when said controller determines that a second predetermined condition exists for a second predetermined period of time, based upon a difference between the first voltage differential and the second voltage differential;

said controller performing the first predetermined operation when said controller determines that a third predetermined condition exists for a third predetermined period of time, based upon the first voltage differential; and said controller performing a second predetermined operation when said controller determines that a third predetermined condition exists, based upon the first voltage differential.

10. The circuit of claim 9, in which:

the first predetermined operation comprises shutting down the circuit; and the second predetermined operation comprises performing a starting operation for a certain period of time.

11. The circuit of claim 1, further comprising:

a voltage sensor that senses a first voltage differential in the circuit;

a second voltage sensor that senses a second voltage differential in the circuit;

said controller shuts down the circuit when said controller determines that a short circuit condition exists, based on the first voltage differential being less than a first predetermined voltage for a first predetermined time period;

said controller shuts down the circuit when said controller determines that a rectification condition exists, based upon a difference between the first voltage differential and the second voltage differential exceeding a second predetermined voltage for a second predetermined time period;

said controller shuts down the circuit when said controller determines that a leaking lamp condition exists, based upon the first voltage differential being less than a third predetermined voltage and more than a first predetermined voltage for a third predetermined time period; and said controller performs a starting operation of the circuit when said controller determines that a no-load condition exists, based upon the first voltage differential exceeding a fourth predetermined voltage for a fourth predetermined time period, wherein the first predetermined period of time is less than or equal to the second predetermined period of time, the third predetermined period of time being greater than the second predetermined period of time, and the fourth predetermined period of time being greater than the third predetermined period of time.

12. The circuit of claim 1, wherein:

said controller controls said plurality of switches to provide a substantially constant first power to the circuit when a lamp voltage is substantially equal to a first voltage;

said controller controls said plurality of switches to provide a power less than the first power and greater than a second power to the circuit when the lamp voltage is higher than a second voltage; and said controller switches to a starting mode when the lamp voltage is higher than a third voltage.

13. The circuit of claim 1, wherein:

said controller lowers a bus voltage after the lamp has been started and a lamp arc has stabilized.

14. The circuit of claim 1, wherein:

said circuit forms a square wave current, said controller turns on a first switch of said plurality of switches at least when another switch of said plurality of switches is on during a first half of a cycle of the square wave current, said controller turning off a second switch and a third switch of said plurality of switches during the first half of the cycle of the square wave current, said controller alternately turning on and off said another switch during the first half of the cycle of the square wave current.

15. The circuit of claim 14, in which:

said controller turns off said first switch and said another switch during a second half of the cycle of the square wave current, said controller alternately turning on and off said third switch during the second half of the cycle of the square wave current, said controller turning on the second switch at least when the third switch is on during the second half of the cycle of the square wave current.

16. The circuit of claim 1, further comprising:

an ignition network having a resistor, an inductor, and a capacitor;

a bulk filter having an inductor and a capacitor; and a peak current sensor.

17. The circuit of claim 1, wherein:

said bridge converter comprises a full bridge converter.

18. The circuit of claim 1, wherein:

said bridge converter comprises a half bridge converter.

19. The circuit of claim 1, wherein each of the plurality of switches comprises one of a switch having a diode inversely connected in parallel with the switch, a MOSFET having an internal inversely connected diode, and an IGBT switch with an internal inversely connected diode.

20. The circuit of claim 1, further comprising:

a voltage sensor that senses a first voltage differential in the circuit, wherein said controller shuts down the circuit when a no-load condition exists, as indicated by the first voltage differential exceeding another predetermined voltage for a predetermined time period.

21. A circuit employing a bridge converter having a plurality of switches connected in series to drive a gas discharge lamp, the circuit comprising:

an ignition network that generates a starting voltage in the circuit;

a controller that controls a repetitive sweeping of a frequency of the starting voltage between a first frequency and a second frequency, wherein a resonant frequency of the ignition network of the circuit is between the first frequency and the second frequency.

22. The circuit of claim 21, wherein:

said controller controls a switching on and off of a first switch and a second switch of the bridge converter of the circuit synchronously; and said controller switches on and off a third switch and a fourth switch of the bridge converter of the circuit synchronously, wherein a duty cycle of the first and second switches differs from a duty cycle of the third and fourth switches.

23. The circuit of claim 21, wherein:

said controller controls an intermittent switching of said plurality of switches.

24. The circuit of claim 21, wherein:

said controller controls a generation of the starting voltage for a first start time period and a turning off of the starting voltage when a lamp voltage is greater than or equal to a predetermined voltage for a second start time period, said controller repeats the generation of the starting voltage for the first time period and the turning off during the second time period during a third start time period, and thereafter implements a circuit cool-off for a fourth start time period.

25. The circuit of claim 24, wherein:

the first start time period is less than the second start time period, and the second time period is less than the fourth start time period.

26. The circuit of claim 24, wherein:

the third time period is less than the fourth start time period.

27. The circuit of claim 21, further comprising:

a voltage sensor that measures a lamp voltage, wherein said controller discontinues generating the starting voltage when the lamp voltage is less than or equal to a predetermined voltage.

28. The circuit of claim 21, wherein each of the plurality of switches comprises one of a switch having a diode inversely connected in parallel with the switch, a MOSFET having an internal inversely connected diode, and an IGBT switch with an internal inversely connected diode.

29. A method for driving a discharge lamp, comprising:

controlling a switching operation of a plurality of switches; and sensing a current flowing through at least one of the plurality of switches by sensing a voltage at a predetermined point of the plurality of switches, wherein a period of time during which at least one of said plurality of switches is turned on in response to a sensed voltage differential is controlled by a controller, the controller determining when to turn on the at least one of the plurality of switches based on the sensed current.

30. A method for driving a discharge lamp, comprising:

generating a starting voltage in a circuit; and sweeping a frequency of the starting voltage between a first frequency and a second frequency, wherein a resonant frequency of an ignition network of the circuit is between the first frequency and the second frequency.

31. A method for driving a discharge lamp, comprising:

obtaining a first voltage differential in a circuit;

determining whether a first predetermined condition exists based upon the first voltage differential;

performing a first predetermined operation when it is determined that said first predetermined condition exists for a first predetermined period of time;

obtaining a second voltage differential in the circuit;

determining whether a second predetermined condition exists based upon a difference between the first voltage differential and the second voltage differential;

performing the first predetermined operation when it is determined that said second predetermined condition exists for a second predetermined period of time;

determining whether a third predetermined condition exists based upon the first voltage differential;

performing the first predetermined operation when it is determined that said third predetermined condition exists for a third predetermined period of time;

determining whether a fourth predetermined condition exists based upon the first voltage differential; and performing a second predetermined operation when it is determined that said fourth predetermined condition exists.

32. The method of claim 31, in which:

the first predetermined operation comprises shutting down the circuit; and the second predetermined operation comprises performing a starting operation for a fourth predetermined period of time.

33. The method of claim 32, in which:

the first predetermined period of time is substantially equal to the second predetermined period of time, the third predetermined period of time being greater than the second predetermined period of time, and the fourth predetermined period of time being greater than the third predetermined period of time.

34. The method of claim 31, wherein:

determining whether the first predetermined condition exists comprises determining whether the first voltage differential is less than a first predetermined voltage;

determining whether the second predetermined condition exists comprises determining whether the difference between the first voltage differential and the second voltage differential exceeds a second predetermined voltage;

determining whether the third predetermined condition exists comprises determining whether the first voltage differential is less than a third predetermined voltage and more than the first predetermined voltage; and determining whether the fourth predetermined condition exists comprises determining whether the first voltage differential exceeds a fourth predetermined voltage.

35. A circuit employing a bridge converter having a plurality of switches connected in series to drive a gas discharge lamp, comprising:

a controller that controls a switching operation of said plurality of switches;

a zero current sensor that senses a current flowing through at least one of said plurality of switches by sensing a voltage at a predetermined point of said plurality of switches; and an ignition network that generates a starting voltage in the circuit;

said controller controls a repetitive sweeping of a frequency of the starting voltage between a first frequency and a second frequency, wherein a resonant frequency of the ignition network of the circuit is between the first frequency and the second frequency, and said controller controls a period of time during which at least one of said plurality of switches is turned on in response to a sensed voltage differential and said controller determines when to turn on said at least one switch in response to a signal produced by an output of said zero current sensor.

* * * * *